US007703519B2

(12) United States Patent
De Francesco

(10) Patent No.: US 7,703,519 B2
(45) Date of Patent: Apr. 27, 2010

(54) COMBINED HYDROGEN PRODUCTION AND UNCONVENTIONAL HEAVY OIL EXTRACTION

(75) Inventor: Errico De Francesco, Newark, DE (US)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 228 days.

(21) Appl. No.: 11/936,890

(22) Filed: Nov. 8, 2007

(65) Prior Publication Data

US 2008/0289820 A1 Nov. 27, 2008

Related U.S. Application Data

(60) Provisional application No. 60/865,753, filed on Nov. 14, 2006.

(51) Int. Cl.
*E21B 43/24* (2006.01)

(52) U.S. Cl. ..... 166/272.6; 166/272.1; 166/272.3; 166/302; 166/303

(58) Field of Classification Search ..... None
See application file for complete search history.

(56) References Cited

U.S. PATENT DOCUMENTS

| | | | | | |
|---|---|---|---|---|---|
| 3,770,398 | A * | 11/1973 | Abraham et al. | ..... | 166/261 |
| 4,114,688 | A * | 9/1978 | Terry | ..... | 166/246 |
| 4,160,479 | A * | 7/1979 | Richardson et al. | ..... | 166/267 |
| 4,476,927 | A * | 10/1984 | Riggs | ..... | 166/261 |
| 4,761,167 | A * | 8/1988 | Nicholas et al. | ..... | 62/626 |
| 6,043,288 | A * | 3/2000 | DeGeorge et al. | ..... | 518/715 |
| 6,540,023 | B2 * | 4/2003 | Davis et al. | ..... | 166/303 |
| 6,662,872 | B2 | 12/2003 | Gutek et al. | | |
| 6,732,796 | B2 * | 5/2004 | Vinegar et al. | ..... | 166/259 |
| 6,805,194 | B2 * | 10/2004 | Davidson et al. | ..... | 166/245 |
| 7,506,685 | B2 * | 3/2009 | Zubrin et al. | ..... | 166/75.11 |
| 2004/0073076 | A1 * | 4/2004 | Drnevich et al. | ..... | 585/809 |
| 2006/0019138 | A1 * | 1/2006 | Jansen et al. | ..... | 429/26 |
| 2007/0124997 | A1 * | 6/2007 | Liu et al. | ..... | 48/198.7 |
| 2008/0257543 | A1 * | 10/2008 | De Francesco et al. | ... | 166/244.1 |

FOREIGN PATENT DOCUMENTS

| | | |
|---|---|---|
| CA | 2147079 | 10/1996 |
| CA | 2185837 | 3/1998 |
| CA | 2281276 | 2/2001 |
| CA | 2323029 | 4/2001 |
| CA | 2391721 | 2/2003 |

* cited by examiner

*Primary Examiner*—George Suchfield
(74) *Attorney, Agent, or Firm*—Elwood L. Haynes

(57) ABSTRACT

A method of producing hydrogen and extracting heavy oil from underground reserves is provided. This method includes providing a carbon monoxide source stream and a water vapor stream to a first reactor, wherein the first reactor comprises a water shift reactor and a membrane-type separation device. This method also includes separating the products of the water shift reactor, thereby producing at least a hydrogen-rich stream, and a high pressure off-gas stream. This method also includes providing the high pressure off-gas stream and an oxidant stream to a combustion chamber. This method also includes combusting the oxidant stream and the high pressure off-gas stream as at least part of a combustion cycle thereby producing a hot injection gas stream. This method also includes combining the hot injection gas stream with a liquid water stream, wherein the combined stream may be used to heat the underground reserve sufficiently to release petroleum hydrocarbons therefrom.

3 Claims, 1 Drawing Sheet

COMBINED HYDROGEN PRODUCTION AND UNCONVENTIONAL HEAVY OIL EXTRACTION

CROSS REFERENCE TO RELATED APPLICATIONS

This application claims the benefit of U.S. Provisional Application No. 60/865,753, filed Nov. 14, 2006, the entire contents of which are incorporated herein by reference.

BACKGROUND

According to current estimations, unconventional heavy oils recoverable reserves alone can satisfy the global demand for 20 years. The development of reliable and economic in-situ extraction technologies is considered to be the key point to unlock the potential of great amounts of hydrocarbon reserves such as those located in the oil sands of Alberta, Canada and the extra heavy oils in the Orinoco Belt of Venezuela.

The mechanism of some existing solutions is deemed to be proven, but the energy requirements of existing technologies are too high to be economical, and none of this technology is really mature enough for companies to be willing to make substantial investments in them.

Existing extraction technologies include Steam Assisted Gravity Drainage (SAGD), which is a steam flooding technique improved by the use of two horizontal wells. One of these wells is for steam injection and the other is for bitumen extraction. The steam heats the formation, increasing the viscosity of the bitumen, which can now flow to the producer. The main drawbacks concern high SOR (steam to oil ratio), which can range from 1.8 to 4.0. The performance of SAGD are strictly dependent upon the reservoir properties and characteristics such as gas caps, aquifers and any shale that may be present in the reservoir. These criteria can result in a potential operation scenario that is not economic. The use of steam alone is deemed to result in a bigger vertical propagation of the steam chamber, potentially resulting in a more pronounced gas over bitumen extraction.

Another existing technology is Vapor Extraction (VE), which involves injecting a gaseous hydrocarbon solvent into the reservoir where it dissolves into the bitumen, which becomes less viscous and can drain into a lower horizontal well and be extracted. The solvent is typically propane, butane or even carbon dioxide along with a carrier gas. The main drawbacks of this technique is that the blending of the oil with the solvent, without heating the formation, produces only small improvements in oil recovery. Also, the solvent is expensive, scarce, and losses in the reservoir can be economically important.

There are also hybrid processes such as ES-SAGD, LASER, or SAVEX (see U.S. Pat. No. 6,662,872), which are currently under development in order to provide a hybrid in-situ extraction technology that couples the advantages of steam (i.e. thermal reduction of oil viscosity) and solvent injection. Light hydrocarbons are used and solutions to drawbacks such as reservoir depressurization and solvent losses have to be provided for. None of these hybrid processes have managed to combine the advantages of thermal extraction with miscible and immiscible flooding

SUMMARY

In one aspect of the present invention a method of producing hydrogen and extracting heavy oil from underground reserves is provided. This method includes providing a carbon monoxide source stream and a water vapor stream to a first reactor, wherein said first reactor comprises a water shift reactor and a membrane separation device. This method also includes separating the products of said water shift reactor, thereby producing at least a hydrogen-rich stream, and a high pressure off-gas stream. This method also includes providing said high pressure off-gas stream and an oxidant stream to a combustion chamber. This method also includes combusting said oxidant stream and said high pressure off-gas stream as at least part of a combustion cycle thereby producing a hot injection gas stream. This method also includes combining said hot injection gas stream with a liquid water stream, wherein said combined stream may be used to heat said underground reserve sufficiently to release petroleum hydrocarbons therefrom.

DESCRIPTION OF FIGURES

The sole FIGURE (FIG. 1) depicts a schematic representation of on embodiment of the present invention.

DETAILED DESCRIPTION

Figure 1:
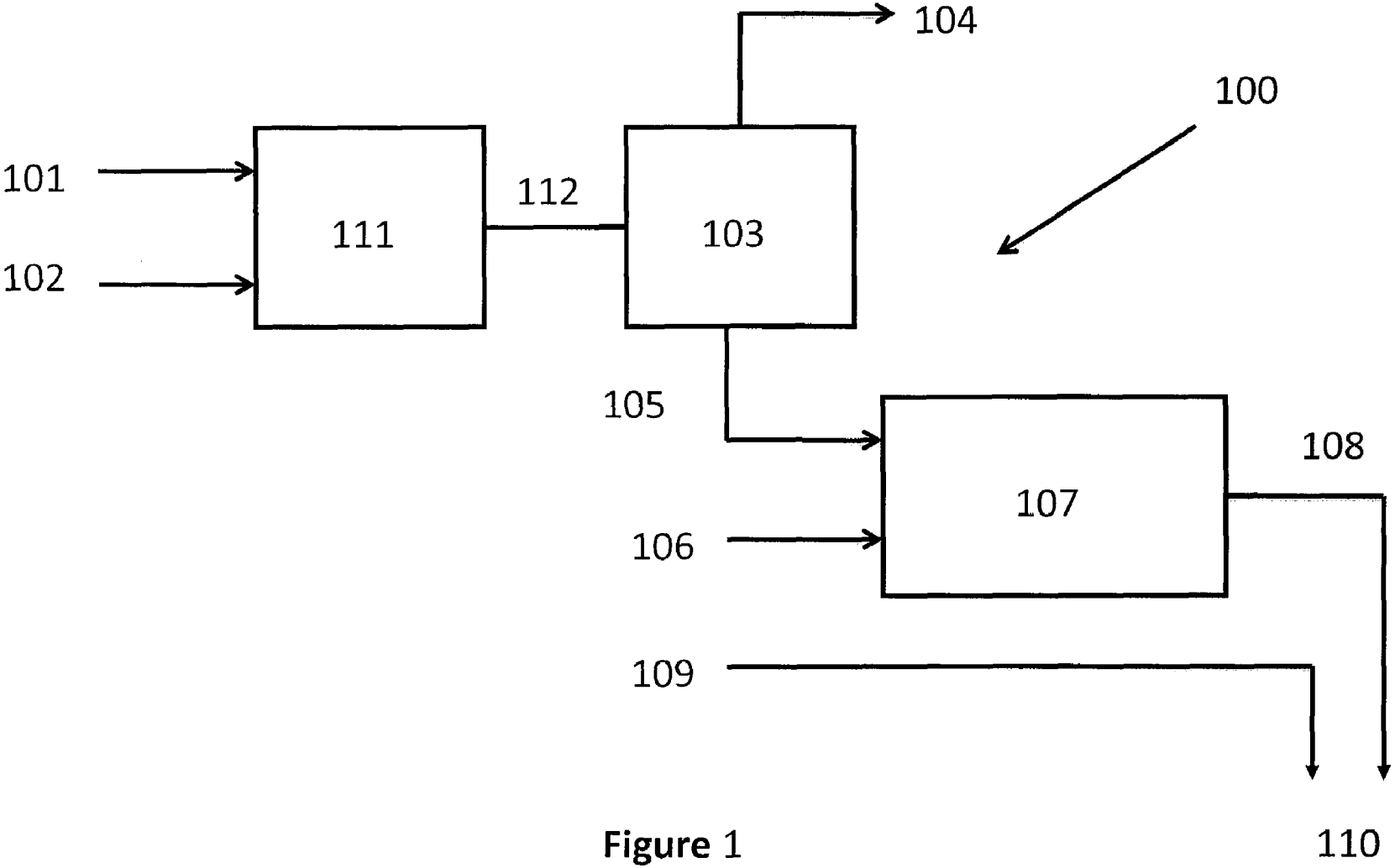

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

This invention applies in particular to the simultaneous production of hydrogen and the economic extraction of heavy oil from difficult underground hydrocarbon reserves. Pressurized syngas (synthesis gas) from production processes such as gasification, partial oxidation, and steam reforming is fed in a Water Gas Shift (WGS) reactor integrated with a membrane system allowing to recover hot hydrogen and hot pressurized off-gas.

This hot pressurized off-gas is then fed to a combustor along with an oxidant, such as air or air that has been supplemented with additional oxygen. This fuel/oxidant combination is then burned which generates a hot exhaust or flue gas. This hot exhaust gas is combined with water, steam, or a combination of the two, with this combined moist, hot stream then being injected into the reservoir for enhanced recovery.

This combustion can be performed in a separate combustor, in an injection well, or in the reservoir itself. Additional pressurized water can also be mixed with the combustion gases or injected directly into the reservoir. Additional pressurized water then vaporizes, helping to control the temperature and enhancing oil recovery. The injection and production wells that recover the oil, can be vertical or horizontal.

Turning now to the sole figure (FIG. 1), one embodiment, system 100, of the invention is presented. A pressurized carbon monoxide source stream 101 is introduced along with a pressurized water vapor stream 102 into a first reactor 103. The carbon dioxide source may be a syngas stream. The first reactor is comprised of a water shift reactor 111 and a membrane separation device 103. The water gas shift reaction is an inorganic chemical reaction in which water and carbon monoxide react to form carbon dioxide and hydrogen (water splitting). The following equation defines the basic reaction in the water shift reactor: $CO+H_2O \leftrightarrows CO_2+H_2$ The hydrogen that is generated in the water shift reactor 111 is separated from the reaction product stream by the membrane separation device 103, and leaves as a product stream 104. The remaining reaction products form high pressure off-gas stream 105. High pressure off-gas stream 105 is then introduced, along with oxidant stream 106, into a combustion chamber 107. The hot combustion product gas stream 108 is then injected, along with liquid water stream 109, into underground reserve 110. The combined heat and moisture of streams 108 and 109 serve to release petroleum hydrocarbons from within the reserve 110. Combustion chamber 107 may be located within underground reserve 110. The pressure of combined injection streams 108 and 109 may be between 290 psi and 1160 psi.

What is claimed is:

1. A method of producing hydrogen and extracting heavy oil from underground reserves, said method comprising:

(a) providing a carbon monoxide source stream and a water vapor stream to a first reactor, wherein said first reactor comprises a water shift reactor and a membrane separation device;

(b) separating the products of said water shift reactor, thereby producing at least a hydrogen-rich stream, and a high pressure off-gas stream;

(c) providing said high pressure off-gas stream and an oxidant stream to a combustion chamber;

(d) combusting said oxidant stream and said high pressure off-gas stream as at least part of a combustion cycle thereby producing a hot injection gas stream; and (e) combining said hot injection gas stream with a liquid water stream, wherein said combined stream is used to heat said underground reserve sufficiently to release petroleum hydrocarbons therefrom.

2. The method of claim 1, wherein said carbon monoxide source is syngas.

3. The method of claim 1, wherein said carbon monoxide source stream is at a pressure of between 290 psi and 1160 psi.

* * * * *